US010289041B1

(12) United States Patent
Kibayashi

(10) Patent No.: US 10,289,041 B1
(45) Date of Patent: May 14, 2019

(54) IMAGE FORMING APPARATUS WITH IMAGE POSITION ADJUSTMENT

(71) Applicant: FUJI XEROX CO.,LTD., Tokyo (JP)

(72) Inventor: Susumu Kibayashi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/001,945

(22) Filed: Jun. 7, 2018

(30) Foreign Application Priority Data

Oct. 19, 2017 (JP) ..... 2017-202540

(51) Int. Cl.
*G03G 15/20* (2006.01)
*G03G 15/00* (2006.01)

(52) U.S. Cl.
CPC ..... *G03G 15/2039* (2013.01); *G03G 15/5062* (2013.01)

(58) Field of Classification Search
CPC ..... G03G 15/2039; G03G 15/5062
See application file for complete search history.

(56) References Cited

U.S. PATENT DOCUMENTS

| | | | | |
|---|---|---|---|---|
| 9,885,989 | B2 | 2/2018 | Tsuno | |
| 2006/0062617 | A1* | 3/2006 | Yamasaki | G03G 15/5062 399/384 |
| 2008/0317486 | A1* | 12/2008 | Monma | G03G 15/0131 399/45 |
| 2012/0081715 | A1* | 4/2012 | Takano | G06K 15/16 358/1.5 |
| 2012/0230719 | A1* | 9/2012 | Matsumoto | G03G 15/2042 399/69 |
| 2016/0109840 | A1* | 4/2016 | Oonishi | G03G 15/652 399/45 |
| 2016/0150117 | A1* | 5/2016 | Furuta | H04N 1/0414 399/45 |
| 2017/0212445 | A1* | 7/2017 | Handa | G03G 15/0266 |
| 2018/0039214 | A1* | 2/2018 | Kawakami | G03G 15/5062 |
| 2018/0101118 | A1* | 4/2018 | Hiroe | G03G 15/5029 |

FOREIGN PATENT DOCUMENTS

| | | |
|---|---|---|
| JP | 2005173253 | 6/2005 |
| JP | 2010097132 | 4/2010 |
| JP | 2015025920 | 2/2015 |
| JP | 2017044978 | 3/2017 |

* cited by examiner

*Primary Examiner* — G. M. A Hyder
(74) *Attorney, Agent, or Firm* — JCIPRNET

(57) ABSTRACT

An image forming apparatus includes the following elements. A transfer unit is disposed in the image forming apparatus to be contactable to and separable from an image carrier and transfers an image on the image carrier to a continuous recording medium. A fixing unit fixes the image on the continuous recording medium by sandwiching it between first and second fixing members. The first and second fixing members are disposed in the image forming apparatus to be contactable to and separable from each other. The position adjusting image detector detects a position adjusting image on the image carrier. A controller performs control so that the first and second fixing members contact each other and the image carrier and the transfer unit contact each other and thereafter so that the position adjusting image is detected by the position adjusting image detector after a transport state of the continuous recording medium is stabilized.

17 Claims, 7 Drawing Sheets

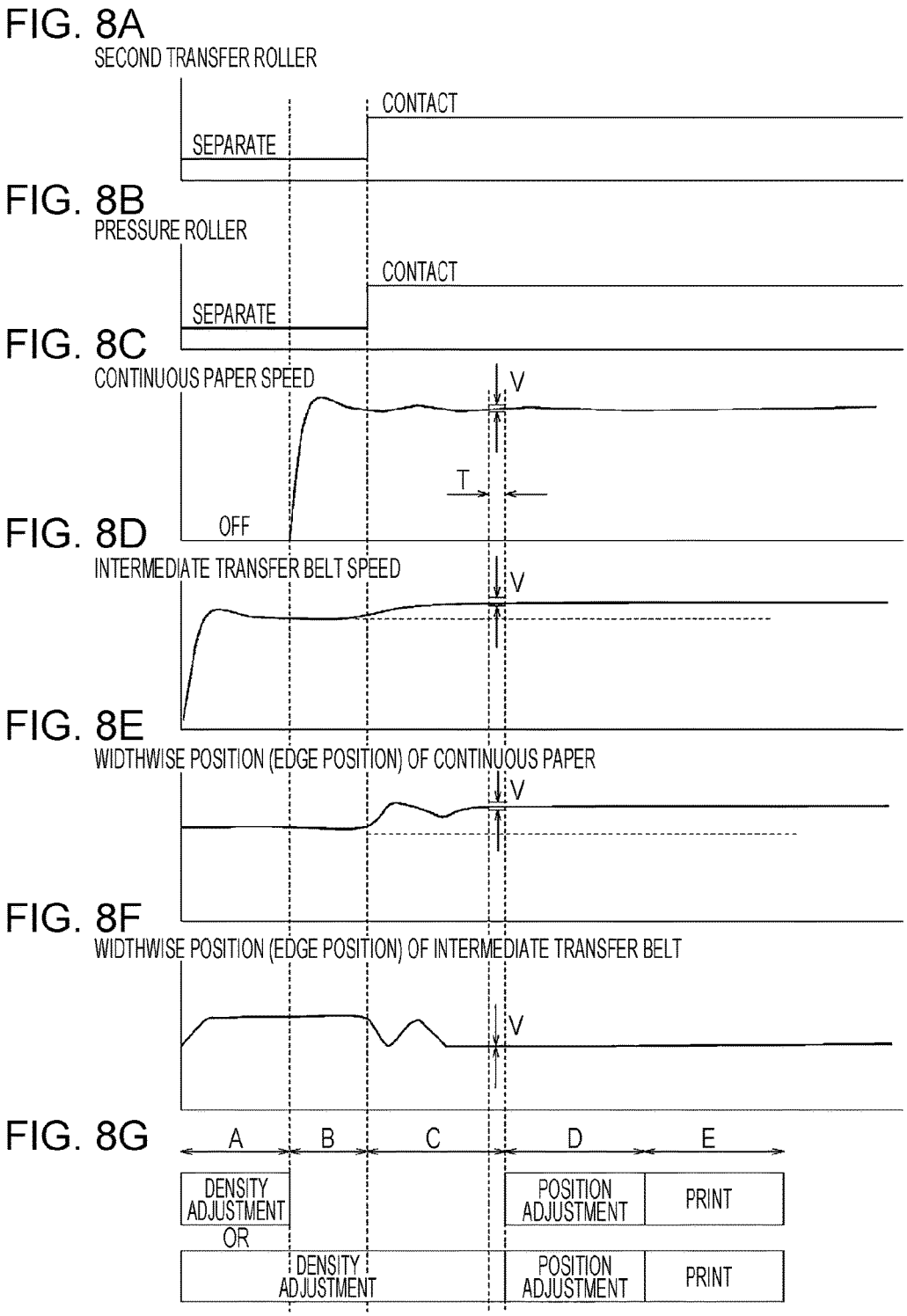
FIG. 8A
SECOND TRANSFER ROLLER
CONTACT
SEPARATE
FIG. 8B
PRESSURE ROLLER
CONTACT
SEPARATE
FIG. 8C
CONTINUOUS PAPER SPEED
V
T
OFF
FIG. 8D
INTERMEDIATE TRANSFER BELT SPEED
V
FIG. 8E
WIDTHWISE POSITION (EDGE POSITION) OF CONTINUOUS PAPER
V
FIG. 8F
WIDTHWISE POSITION (EDGE POSITION) OF INTERMEDIATE TRANSFER BELT
V
FIG. 8G
A
B
C
D
E
DENSITY ADJUSTMENT
POSITION ADJUSTMENT
PRINT
OR
DENSITY ADJUSTMENT
POSITION ADJUSTMENT
PRINT

IMAGE FORMING APPARATUS WITH IMAGE POSITION ADJUSTMENT

CROSS-REFERENCE TO RELATED APPLICATIONS

This application is based on and claims priority under 35 USC 119 from Japanese Patent Application No. 2017-202540 filed Oct. 19, 2017.

BACKGROUND

Technical Field

The present invention relates to an image forming apparatus.

SUMMARY

According to an aspect of the invention, there is provided an image forming apparatus including a transfer unit, a fixing unit, a position adjusting image detector, and a controller. The transfer unit is disposed in the image forming apparatus so as to be contactable to and separable from an image carrier and transfers an image formed on the image carrier to a continuous recording medium. The fixing unit fixes the image transferred to the continuous recording medium by sandwiching the continuous recording medium between first and second fixing members. The first and second fixing members are disposed in the image forming apparatus so as to be contactable to and separable from each other. The position adjusting image detector detects a position adjusting image formed on the image carrier. The controller performs control so that the first and second fixing members contact each other and the image carrier and the transfer unit contact each other and thereafter so that the position adjusting image is detected by the position adjusting image detector after a transport state of the continuous recording medium is stabilized.

BRIEF DESCRIPTION OF THE DRAWINGS

An exemplary embodiment of the present invention will be described in detail based on the following figures, wherein:

FIGS. 8A through 8G are a timing chart of some elements forming the image forming apparatus.

DETAILED DESCRIPTION

Figure 1:
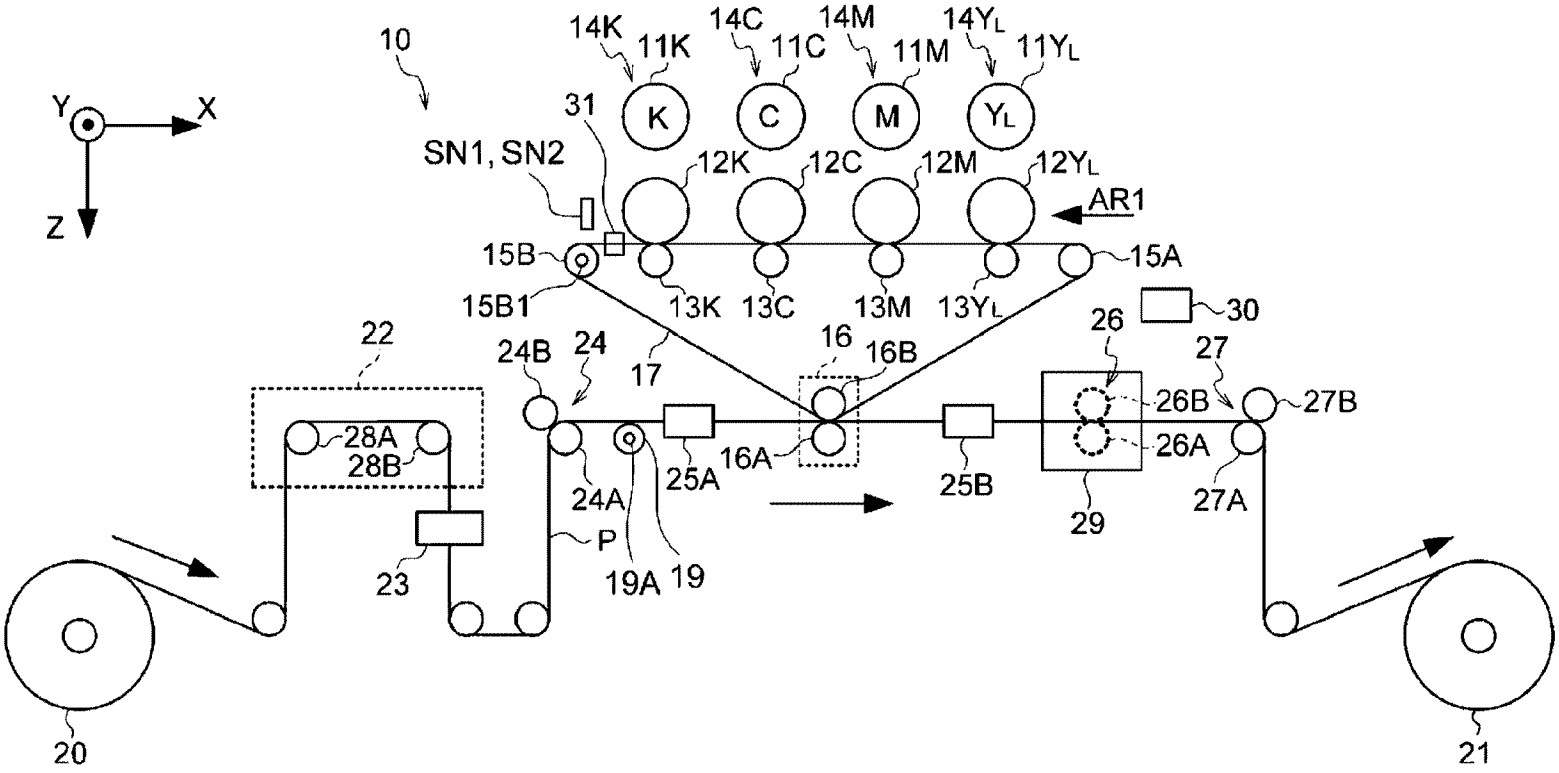
FIG. 1 is a schematic side view illustrating an example of the configuration of the major parts of an image forming apparatus.

An exemplary embodiment will be described below with reference to the accompanying drawings. Elements having the same functions are designated by like reference numeral in the drawings and an explanation thereof will not be repeated. An explanation of the same operation will not be repeated, either.

Concerning alphabets representing colors, that is, yellow, magenta, cyan, and black, will be designated by $Y_L$, M, C, and K, respectively. If it is necessary to explain an element forming an image forming apparatus of this exemplary embodiment according to the color, the above-described alphabets $Y_L$, M, C, and K are appended to the reference numeral of this element so that units corresponding to the individual colors forming this element can be distinguished from each other. If an element forming the image forming apparatus is collectively described regardless of the color, the alphabets $Y_L$, M, C, and K are not appended to the reference numeral of this element.

FIG. 1 is a schematic side view illustrating an example of the configuration of the major parts of an image forming apparatus 10 according to the exemplary embodiment.

The image forming apparatus 10 forms an image represented by data of an original image selected by a user on a recording medium by using toners of $Y_L$, M, C, and K four colors. The original image may be the one selected by a user or may be the one automatically selected by a computer.

The image forming apparatus 10 includes an image forming device 14. The image forming device 14 forms toner images of the individual colors to be transferred to an intermediate transfer belt 17. Hereinafter, toner images transferred onto a recording medium may simply be called an image or images. The intermediate transfer belt 17 is an example of an image carrier.

The image forming device 14 is constituted by four image forming devices 14$Y_L$, 14M, 14C, and 14K used specially for forming $Y_L$, M, C, and K toner images, respectively.

Each image forming device 14 includes a photoconductor 12, a charging device, an exposure device, a developing device, and a cleaning device, which are not shown except for the photoconductor 12. The image forming device 14 is an example of an image forming unit.

The charging device, which is not shown, includes a contact charging roller which is disposed in contact with the photoconductor 12. The contact charging roller charges the surface of the photoconductor 12 in accordance with a voltage supplied from a charging power supply, which is not shown.

The exposure device, which is not shown, irradiates the charged surface of the photoconductor 12 with light which is modulated in accordance with the data values of the original image so as to form an electrostatic latent image on the surface of the photoconductor 12.

The developing device, which is not shown, develops the electrostatic latent image formed on the surface of the photoconductor 12 by using a developer toner of a corresponding color so as to generate a toner image.

A first transfer device 13 is disposed to contact the photoconductor 12 with the intermediate transfer belt 17 therebetween. The first transfer device 13 applies an electric field of the polarity opposite the toner image to the photoconductor 12 so that the toner image on the photoconductor 12 will be transferred to the intermediate transfer belt 17. The toner images of the corresponding colors formed on the photoconductors 12 are superposed on each other on the intermediate transfer belt 17 in this manner. The transfer operation of toner images onto the intermediate transfer belt 17 is called a first transfer operation.

The intermediate transfer belt 17 is wound on support rollers 15A and 15B and a backup roller 16B which forms a second transfer device 16. The support roller 15A is driven by a motor, which is not shown, to be rotated so as to transport the intermediate transfer belt 17 in a direction indicated by the arrow AR1 in FIG. 1.

A belt speed detector 15B1 is provided on the rotating shaft of the support roller 15B. The belt speed detector 15B1 is constituted by a rotary encoder, for example. The speed of the intermediate transfer belt 17 is detected based on a signal output from the rotary encoder.

The toner images transferred to the intermediate transfer belt 17 are transported to a gap formed between a second transfer roller 16A and the backup roller 16B of the second transfer device 16 (hereinafter, such a gap will be called a nip part). At this time, the second transfer device 16 applies an electric field of the polarity opposite the toner images from the second transfer roller 16A to the intermediate transfer belt 17 so as to electrostatically attract the toner images on the intermediate transfer belt 17 and transfer them to a recording medium. The transfer operation of toner images onto a recording medium is called a second transfer operation. The second transfer roller 16A is an example of a transfer unit.

Figure 2:
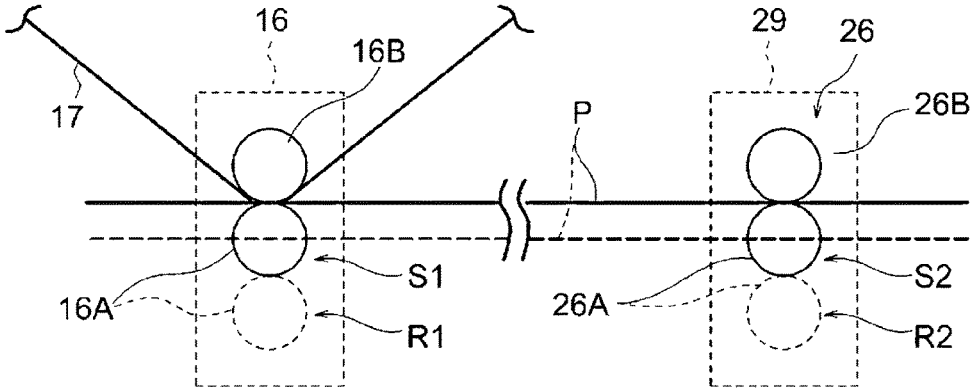
FIG. 2 is a view for explaining a contact position and a separate position of a second transfer roller and those of a pressure roller.

The second transfer roller 16A and the intermediate transfer belt 17 are disposed in the image forming apparatus 10 so as to be contactable to and separable from each other. During a period for which operation for transferring an image formed on the intermediate transfer belt 17 to a recording medium is performed, the second transfer roller 16A is moved and located at a contact position S1. The contact position S1 is a position at which the second transfer roller 16A contacts the intermediate transfer belt 17 with continuous paper P indicated by the solid line therebetween, as shown in FIG. 2. During a period for which operation for transferring an image formed on the intermediate transfer belt 17 to a recording medium is not performed, the second transfer roller 16A is moved and located at a separate position R1. The separate position R1 is a position at which the second transfer roller 16A does not contact the intermediate transfer belt 17 and separates from continuous paper P indicated by the broken line, as shown in FIG. 2.

Transporting of a recording medium in the image forming apparatus 10 will now be discussed below.

As a recording medium, the image forming apparatus 10 uses a long continuous recording medium, instead of cut sheets which are cut into a predetermined size (A4 size, for example). As the continuous recording medium, any type of recording medium, such as paper and film-like sheets, on which toner images can be fixed may be used. In the exemplary embodiment, continuous paper P is used as an example.

As the continuous paper P, synthetic paper made from a synthetic resin such as polypropylene, glassine paper, fine paper, may be used. In this exemplary embodiment, a label sheet is used. A label sheet is a sheet in which a surface base is attached onto a release liner serving as a carrier via an adhesive layer containing an adhesive material, such as glue. The release liner is disposed of after the surface base is removed from the label sheet.

The continuous paper P is rolled on a sheet feeder 20 of the image forming apparatus 10 so that an image will be formed on the surface base of the label sheet. One end of the continuous paper P is fixed to a rewinder 21. Rotating the rewinder 21 transports the continuous paper P in a transport direction indicated by the arrow X takes it up on the rewinder 21.

On a transport path through which the continuous paper P is transported, a deviation control device 22, a deviation-control position detector 23, a first rotating pair 24, transport position detectors 25A and 25B, the second transfer device 16, a fixing device 26, a second rotating pair 27, and a drive device 29 are disposed.

Figure 3:
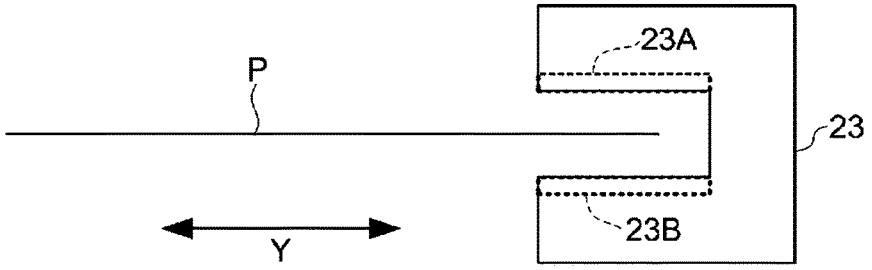
FIG. 3 illustrates an example of the positional relationship between a deviation-control position detector and continuous paper.

FIG. 3 illustrates an example of the positional relationship between the deviation-control position detector 23 and the continuous paper P. As shown in FIG. 3, the deviation-control position detector 23 is formed in a U-like shape having two projecting portions, for example, and the end portion of the continuous paper P along the transport direction passes by a gap formed between the two projecting portions.

A light-emitting element 23A is disposed on one projecting portion, while a light-receiving element 23B is disposed on the other projecting portion.

If the end portion of the continuous paper P deviates in a direction (Y direction indicated by the arrow in FIG. 3) perpendicular to the transport direction of the continuous paper P, the amount of light received by the light-receiving element 23B of the deviation-control position detector 23 changes. As a result, the position of the continuous paper P is detected from the amount of received light. The position of the continuous paper P detected by the deviation-control position detector 23 is output to a control device 30 as a voltage value or a current value, for example.

Hereinafter, the length of the continuous paper P in the direction perpendicular to the transport direction will be called the width of the continuous paper P, and the direction perpendicular to the transport direction will be called the widthwise direction of the continuous paper P. The end portion of the continuous paper P indicates at least one of the two ends of the continuous paper P along the transport direction. The position of the end portion of the continuous paper P or the position of the continuous paper P in the widthwise direction indicates the transport position at the widthwise end portion of the continuous paper P.

As shown in FIG. 1, the deviation control device 22 includes deviation control rollers 28A and 28B. If the deviation-control position detector 23, which is disposed farther downstream in the transport direction than the deviation control device 22, detects a state in which the continuous paper P is transported while it deviates from a reference position, the deviation control device 22 adjusts the end portion of the continuous paper P to the reference position in the following manner, for example. In a plane along the continuous paper P (hereinafter called the transport plane), the rotating shafts of the deviation control rollers 28A and 28B are tilted with respect to the direction perpendicular to the transport direction in which the end portion of the continuous paper P would be at the reference position. The widthwise direction of the continuous paper P in which the end portion of the continuous paper P is at the reference position will be called the reference widthwise direction.

The reference position is an ideal position of the end portion of the continuous paper P at which the image forming apparatus 10 can form an image at a correct position on the continuous paper P as a user has intended. That is, the image forming apparatus 10 is designed to reduce misregistration between the position of an original image and that of an image formed on the continuous paper P if the end portion of the continuous paper P is located at the reference position. Reducing misregistration between the position of an original image and that of an image formed on the continuous paper P refers to that an image corresponding to the original image can be formed on the continuous paper P substantially without distortion or there is only a small misalignment between the position of continuous paper P (the center of the widthwise direction of the continuous paper P, for example) on which an image will be formed and the position of the continuous paper P at which the image is actually formed.

The first rotating pair 24 includes a first drive roller 24A and a first pinch roller 24B. The first rotating pair 24 is rotated at a predetermined rotational speed while the continuous paper P is inserted in a nip part between the first drive roller 24A and the first pinch roller 24B so as to reduce a variation in the transport speed of the continuous paper P.

To reduce a variation in the transport speed of the continuous paper P, it is desirable that a strong force be exerted to transport the continuous paper P at a predetermined transport speed (which will be called the reference transport speed) without being influenced by a variation in the transport speed. Such a force will be called the transport force.

To enhance the transport force for the continuous paper P, the first drive roller 24A is located at a position at which the contact area of the continuous paper P around the first drive roller 24A can be maximized. Additionally, an elastic member, such as silicone rubber, is used for the surface of the first pinch roller 24B. Then, the surface of the first pinch roller 24B elastically deforms to press the continuous paper P against the first drive roller 24A. This increases a friction force between the continuous paper P and the first drive roller 24A, compared with that when the surface of the first pinch roller 24B is made of a metal, thereby enhancing the transport force for the continuous paper P. The transport force is expressed by a pressing force exerted at the nip part between the first drive roller 24A and the first pinch roller 24B.

A speed detecting roller 19 is disposed farther downstream in the transport direction than the first rotating pair 24. The speed detecting roller 19 is driven when the continuous paper P is transported. A continuous-paper speed detector 19A is provided on the rotating shaft of the speed detecting roller 19. The continuous-paper speed detector 19A is constituted by a rotary encoder, for example. The speed of the continuous paper P is detected based on a signal output from the rotary encoder.

The structure of the transport position detectors 25A and 25B is the same as the deviation-control position detector 23 shown in FIG. 3. The transport position detectors 25A and 25B are disposed on at least one end portion of the continuous paper P. As viewed from the second transfer device 16, for example, the transport position detector 25A is disposed at the upstream side in the transport direction of the continuous paper P, while the transport position detector 25B is disposed at the downstream side in the transport direction of the continuous paper P. That is, the transport position detectors 25A and 25B are disposed such that they sandwich the second transfer device 16 therebetween along the transport direction of the continuous paper P. If it is not necessary to distinguish the transport position detectors 25A and 25B from each other, they will be called the transport position detector 25.

The fixing device 26 includes a pressure roller 26A and a heat roller 26B. An elastic member, such as silicone rubber, is used for the surface of the pressure roller 26A. The heat roller 26B is heated upon receiving power from a power source, which is not shown. The pressure roller 26A and the heat roller 26B are rotated in a state in which the continuous paper P with a transferred image is inserted in a nip part between the pressure roller 26A and the heat roller 26B.

The pressure roller 26A and the heat roller 26B are disposed in the image forming apparatus 10 so as to be contactable to and separable from each other. During a period for which operation for fixing an image formed on continuous paper P is performed, the pressure roller 26A is moved and located at a contact position S2 at which it contacts the heat roller 26B with the continuous paper P indicated by the solid line therebetween, as shown in FIG. 2. During a period for which operation for fixing an image formed on continuous paper P is not performed, the pressure roller 26A is moved and located at a separate position R2 at which it does not contact the heat roller 26B and separates from the continuous paper P indicated by the broken line, as shown in FIG. 2.

The fixing device 26 is an example of a fixing unit. The pressure roller 26A is an example of a first fixing member, while the heat roller 26B is an example of a second fixing member.

The fixing device 26 presses the image against the continuous paper P by using a pressing force at the nip part of the fixing device 26 and heats toner contained in the image with heat of the heat roller 26B, thereby fixing the image on the continuous paper P.

The second rotating pair 27 includes a second drive roller 27A and a second pinch roller 27B. The second rotating pair 27 is rotated while the continuous paper P is inserted in a nip part between the second drive roller 27A and the second pinch roller 27B so that the tension of the transported continuous paper P will be regulated to a predetermined tension.

A torque limiter device, which is not shown, for example, is connected to the second drive roller 27A. The torque limiter device controls the second rotating pair 27 so that the tension of the continuous paper P will be regulated to the predetermined tension (hereinafter called the reference tension) without exceeding the reference tension.

As in the first drive roller 24A, the second drive roller 27A is located at a position at which the contact area of the continuous paper P around the second drive roller 27A can be maximized.

Additionally, as in the first pinch roller 24B, an elastic member, such as silicone rubber, is used for the surface of the second pinch roller 27B. This increases a friction force between the continuous paper P and the second drive roller 27A, compared with when a metal is used for the surface of the second pinch roller 27B, thereby enhancing the transport force for the continuous paper P.

The drive device 29 is a device for shifting one end portion of the fixing device 26 with respect to the widthwise direction of the continuous paper P in the transport direction so as to adjust the angle between the reference widthwise direction of the continuous paper P and the rotating shaft of each of the pressure roller 26A and the heat roller 26B of the fixing device 26. Such an angle will hereinafter be called a mounting angle.

Devices related to the transporting of the continuous paper P, that is, the sheet feeder 20, the rewinder 21, the first and second rotating pairs 24 and 27, a moving device (not shown) for moving the second transfer roller 16A to the contact position S1 or the separate position R1, and a moving device (not shown) for moving the pressure roller 26A to the contact position S2 or the separate position R2 are an example of a transport device 18.

The above-described devices forming the image forming apparatus 10 are controlled by the control device 30.

Transporting of continuous paper P in the image forming apparatus 10 will be described in greater detail with reference to FIG. 4.

Figure 4:
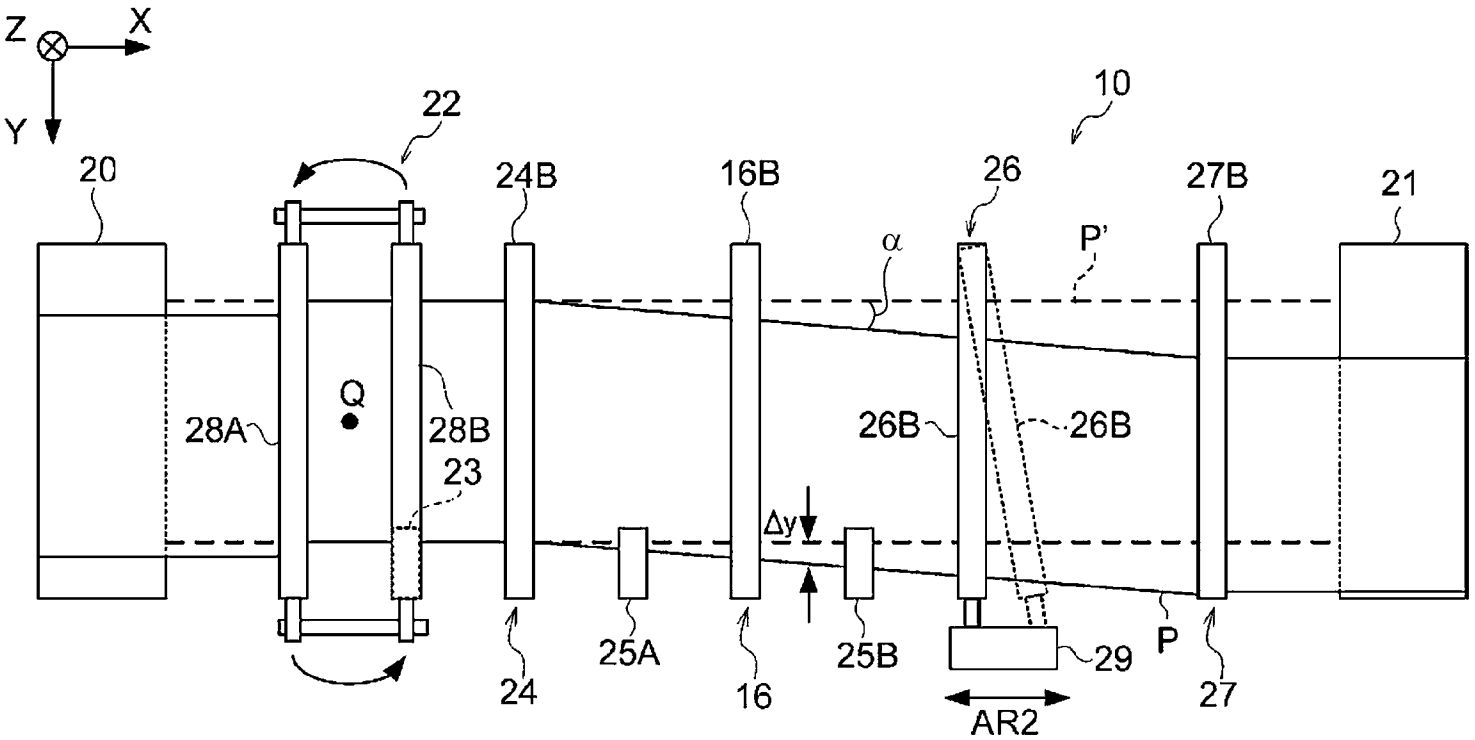
FIG. 4 is a schematic plan view illustrating an example of the configuration of the major parts of the image forming apparatus.

FIG. 4 is a schematic plan view of the image forming apparatus 10 shown in FIG. 1 when viewing the image forming surface of continuous paper P from above.

The first transfer device 13, the image forming device 14, the support rollers 15A and 15B, and the intermediate transfer belt 17, which are not related to the transport state of continuous paper P, are not shown. The position of continuous paper P indicated by the solid lines represents an example of the actual position of continuous paper transported by the image forming apparatus 10. The position of continuous paper P' indicated by the broken lines represents an example of the position of continuous paper when the end portion of the continuous paper P is located at the reference position.

The transport position of continuous paper at which the end portion of the continuous paper is located at the reference position, that is, the transport position represented by the continuous paper P' has been determined as a reference transport position. The image forming apparatus 10 is designed to reduce misregistration between the position of an original image and that of an image formed on continuous paper P if the continuous paper P is transported along the reference transport position.

However, due to deviation of the mounting position of continuous paper P on the sheet feeder 20, for example, the transport position of the continuous paper P may shift in the widthwise direction of the continuous paper P and deviate from the reference transport position.

When the deviation-control position detector 23 has detected that the continuous paper P is transported while the end portion of the continuous paper P deviates from the reference position, the image forming apparatus 10 shifts the transport position of the continuous paper P to the reference transport position by rotating the deviation control rollers 28A and 28B. In this case, the deviation control rollers 28A and 28B are rotated in the transport plane of the deviation control device 22 around the center point Q as the axis of rotation.

However, even if the transport position of the continuous paper P is adjusted to the reference transport position by the deviation control device 22, it may deviate from the reference transport position on the transport path farther downstream than the deviation control device 22 (between the first rotating pair 24 and the second rotating pair 27, for example), as shown in FIG. 4.

This is due to a deviation of the mounting angle of a rotating body with respect to the reference widthwise direction of the continuous paper P. Examples of the rotating body are the first and second rotating pairs 24 and 27, the second transfer device 16, and the fixing device 26.

If a rotating body is mounted at an angle deviating from a correct angle with respect to the reference widthwise direction of the continuous paper P, the continuous paper P is transported while deviating from a predetermined transport direction at a certain angle. The predetermined transport direction is a direction in which the continuous paper P is transported in a state in which the end portion of the continuous paper P is located at the reference position.

If, in particular, a rotating body which exerts a stronger transport force for the continuous paper P than the other rotating bodies used for transporting the continuous paper P is mounted at an angle deviating from a correct angle, the continuous paper P is more likely to be transported while deviating from the predetermined transport direction at a certain angle due to this strong transport force.

The transport force of the first and second rotating pairs 24 and 27, the second transfer device 16, and the fixing device 26, which are rotating bodies disposed on the transport path of the continuous paper P, will now be discussed.

The second transfer device 16 electrostatically attracts toner images on the intermediate transfer belt 17 and transfers them to continuous paper P. In contrast, the fixing device 26 transports continuous paper P while pressing an image transferred to the continuous paper P against the continuous paper P. The first rotating pair 24 transports continuous paper P at a reference transport speed, while the second rotating pair 27 transports continuous paper P at a reference tension. The second transfer device 16 thus requires a smaller transport force than that of each of the fixing device 26 and the first and second rotating pairs 24 and 27.

That is, deviation of continuous paper P in the transport direction is due to deviation of the mounting angle of the first and second rotating pairs 24 and 27 and the fixing device 26, which exert a stronger transport force than the second transfer device 16, with respect to the reference widthwise direction of the continuous paper P.

Regarding each of the first pinch roller 24B of the first rotating pair 24, the pressure roller 26A of the fixing device 26, and the second pinch roller 27B of the second rotating pair 27, an elastic member is used for the surface of the rotating body. Due to the deformation of a nip part which accompanies a pressing force of a pair of rotating bodies, the transport direction of the continuous paper P may deviate from the predetermined transport direction. The nip part is desirably formed in a rectangular shape having a long side in the widthwise direction of the continuous paper P. Deformation of the nip part into another shape, such as a trapezoid, will simply be called the deformation of the nip part.

As shown in FIG. 4, due to the deviation of the mounting angle of the first rotating pair 24, which exert a stronger transport force than the second transfer device 16, and the deformation of the nip part, the continuous paper P starts to deviate from the predetermined transport direction at a certain angle. Additionally, when the first and second rotating pairs 24 and 27 and the fixing device 26 are driven, the transport position of the continuous paper P adjusted to the reference transport position by the deviation control device 22 is also shifted in the widthwise direction.

To completely eliminate the deviation of the mounting angles of these devices and the deformation of the nip parts, high processing technology is required for significantly enhancing the circularity of the rotating bodies or the precision in the position of the mounting holes. This increases the cost of the image forming apparatus 10.

Instead, in the image forming apparatus 10, in accordance with the angle between the predetermined transport direction and the actual transport direction (hereinafter such an angle will be called the transport angle $\alpha$), one end portion of the fixing device 26 in the widthwise direction of the continuous paper P is shifted in the direction indicated by the arrow AR2 shown in FIG. 4, that is, in the transport direction of the continuous paper P. As a result, the mounting angle of the fixing device 26 is adjusted, so that the transport angle $\alpha$ of the continuous paper P can approach 0 degrees.

To allow for a deviation $\Delta y$ of the transport position of the continuous paper P which may be caused farther downstream in the transport direction than the deviation control device 22, the image forming apparatus 10 further adjusts the rotating direction of the deviation control device 22 so that the transport position of the continuous paper P can be the reference transport position.

A transport position detector 31 is disposed between the first transfer device 13K and the support roller 15B, as shown in FIG. 1. The transport position detector 31 has the same structure as the deviation-control position detector 23 shown in FIG. 3, and detects the position of the end portion of the intermediate transfer belt 17.

A density-adjusting-image detector sensor SN1 and a position-adjusting-image detector sensor SN2 are disposed farther downstream in the transport direction AR1 than the transport position detector 31. The density-adjusting-image detector sensor SN1 detects a density adjusting image transferred to the intermediate transfer belt 17. The position-adjusting-image detector sensor SN2 detects a position adjusting image transferred to the intermediate transfer belt 17. The density-adjusting-image detector sensor SN1 is an example of a density adjusting image detector. The position-adjusting-image detector sensor SN2 is an example of a position adjusting image detector.

Figure 5:
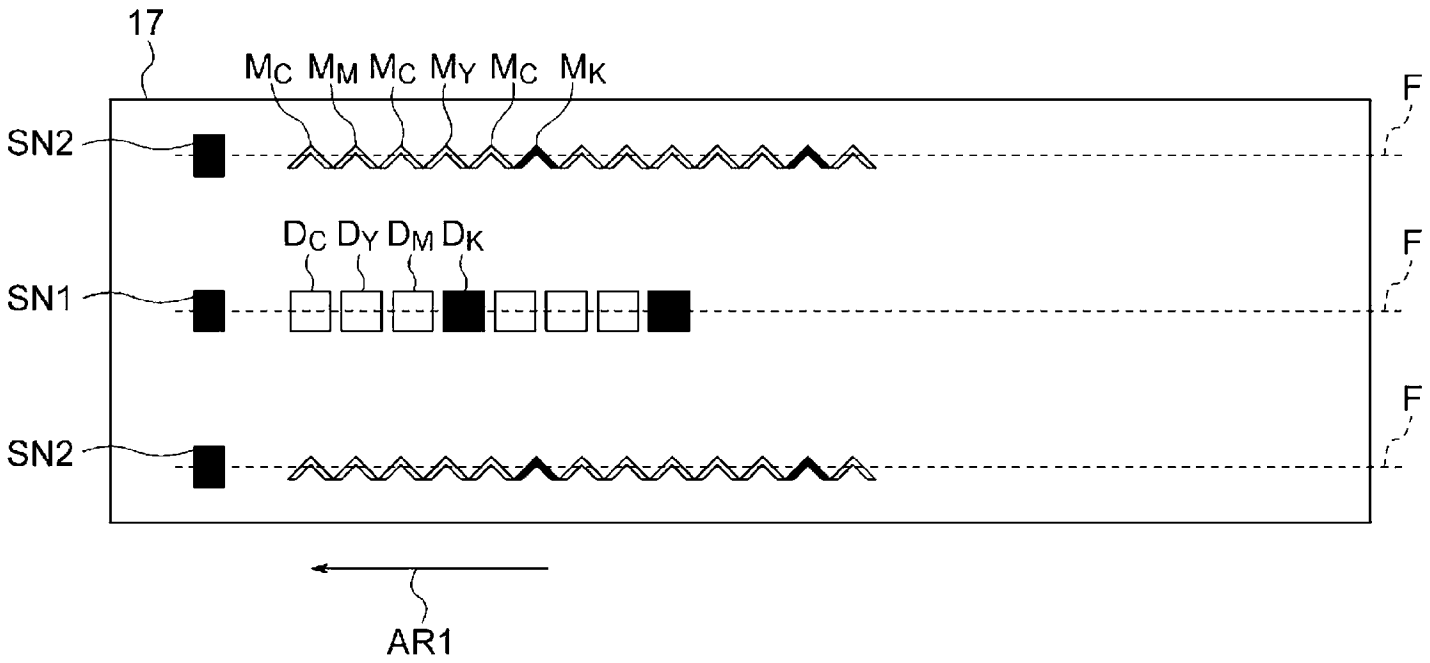
FIG. 5 illustrates an example of density adjusting images and an example of position adjusting images.

As shown in FIG. 5, the density-adjusting-image detector sensor SN1 is disposed at the central portion of the intermediate transfer belt 17 in the widthwise direction. The position-adjusting-image detector sensor SN2 is disposed at each end portion of the intermediate transfer belt 17 in the widthwise direction.

A reading position F indicates a position at which each of the density-adjusting-image detector sensor SN1 and the position-adjusting-image detector sensor SN2 reads a corresponding image. In density adjusting processing, which will be discussed later, cyan, yellow, magenta, and black density adjusting images $D_C$, $D_Y$, $D_M$, and $D_K$ are formed at positions corresponding to the reading position F at the central portion of the intermediate transfer belt 17 in the widthwise direction.

In position adjusting processing, which will be discussed later, cyan, yellow, magenta, and black position adjusting images $M_C$, $M_Y$, $M_M$, and $M_K$ are formed at positions corresponding to the reading position F at each end portion of the intermediate transfer belt 17 in the widthwise direction.

If density adjusting images and position adjusting images are each collectively described regardless of the color, the alphabets C, Y, M, and K are not appended.

Figure 6:
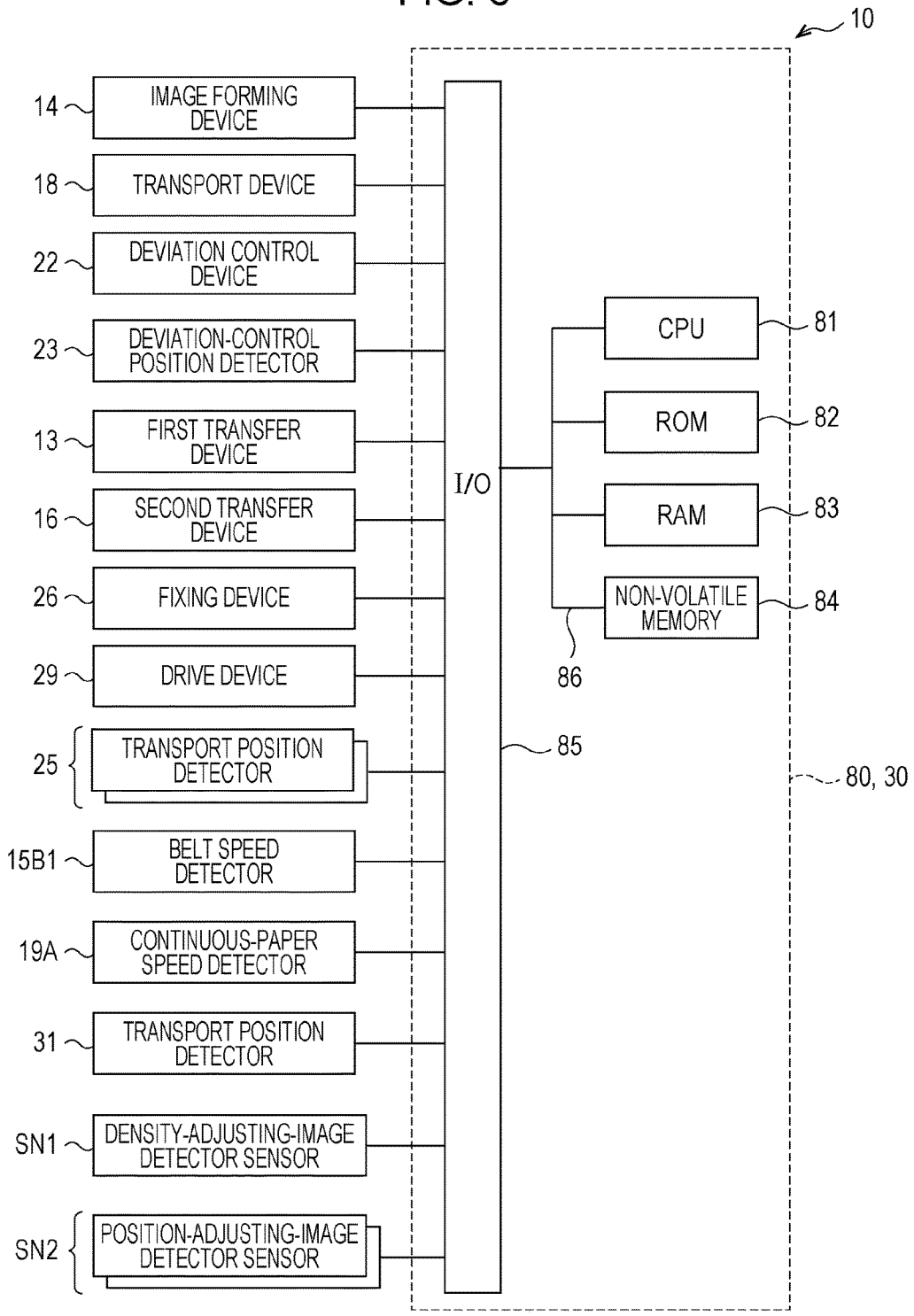
FIG. 6 is a block diagram illustrating an example of the configuration of the major parts of the electrical system of the image forming apparatus.

FIG. 6 is a block diagram illustrating an example of the configuration of the major parts of the electrical system of the image forming apparatus 10. As shown in FIG. 6, a computer 80, for example, is used for the control device 30 of the image forming apparatus 10.

The computer 80 includes a central processing unit (CPU) 81, a read only memory (ROM) 82, a random access memory (RAM) 83, a non-volatile memory 84, and an input/output port (I/O) 85. The CPU 81, the ROM 82, the RAM 83, the non-volatile memory 84, and the I/O 85 are connected to one another via a bus 86. The CPU 81 reads a program from the ROM 82 and executes it by using the RAM 83 as a work area. The non-volatile memory 84 is a memory which retains stored data even if the image forming apparatus 10 is powered OFF. Parameters used in executing the program are stored in the non-volatile memory 84. The CPU 81 is an example of a controller.

The image forming device 14, the transport device 18, the deviation control device 22, the deviation-control position detector 23, the first transfer device 13, the second transfer device 16, the fixing device 26, the drive device 29, the transport position detector 25, the belt speed detector 15B1, the continuous-paper speed detector 19A, the transport position detector 31, the density-adjusting-image detector sensor SN1, and the position-adjusting-image detector sensor SN2 are connected to the I/O 85, and are controlled by the CPU 81.

The devices connected to the I/O 85 are only examples and are not restricted to those shown in FIG. 6. For example, a communication device and an interface device may be connected to the I/O 85. The communication device is connected to a communication network, such as the Internet, so as to send and receive data. The interface device includes an input unit, such as buttons and a touchscreen, and a display, such as a liquid crystal display (LCD).

Image quality adjusting processing executed in the image forming apparatus 10 by the CPU 81 of the control device 30 will be described below.

Image quality adjusting processing, which is executed before an image is formed on continuous paper P, includes density adjusting processing and position adjusting processing.

Figure 7:
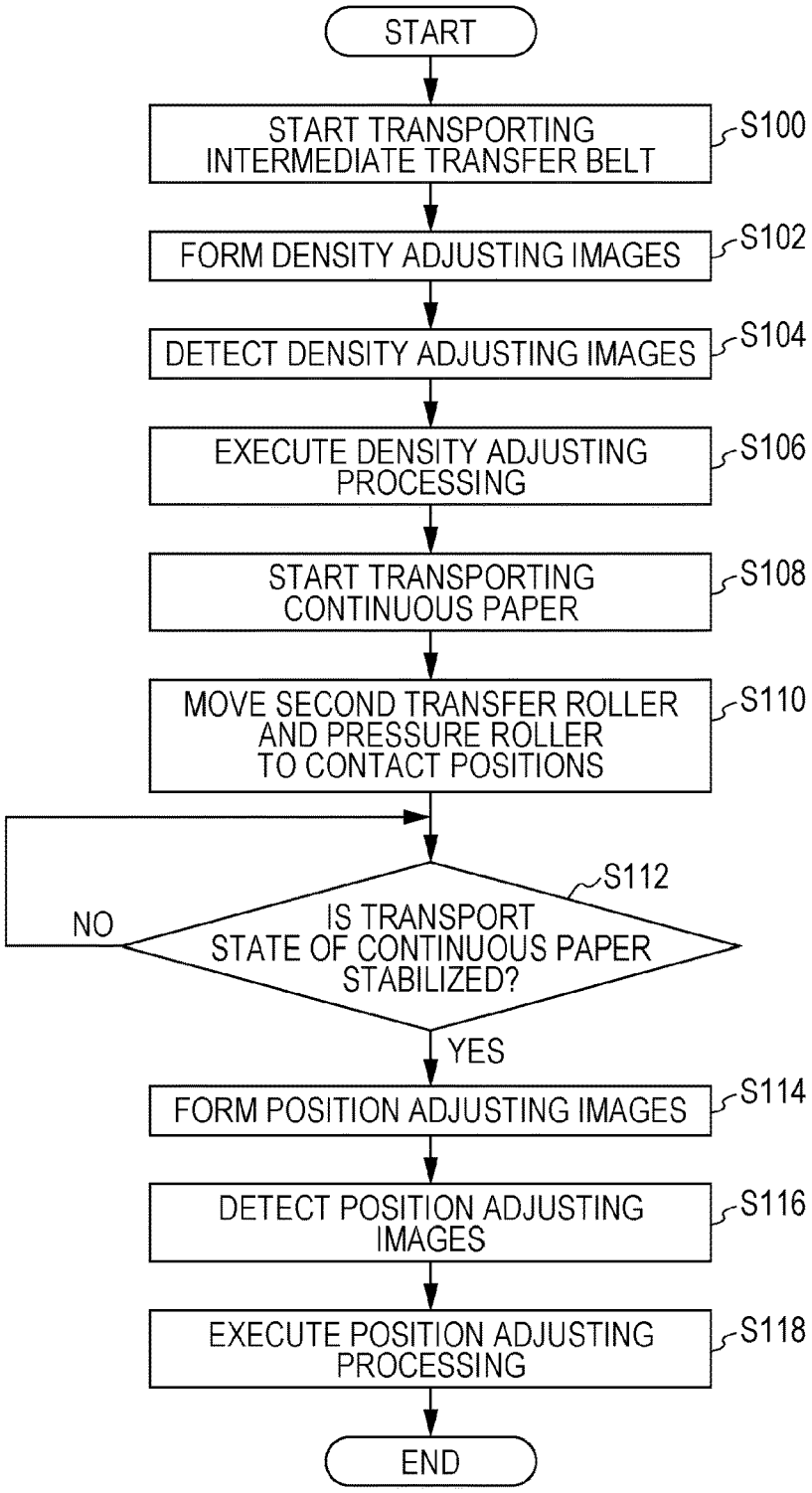
FIG. 7 is a flowchart illustrating an example of image quality adjusting processing.

FIG. 7 is a flowchart illustrating an example of image quality adjusting processing. An image quality adjusting program for executing image quality adjusting processing is stored in the ROM 82. Upon receiving an original image and an image forming instruction from a user, the CPU 81 reads the image quality adjusting program from the ROM 82 and executes it, thereby performing image quality adjusting processing.

During a standby period for which no image forming instruction is received from a user, the fixing device 26 is not required to fix an image on continuous paper P. Hence, at a time point when image quality adjusting processing shown in FIG. 7 is started, the pressure roller 26A is located at the separate position R2 shown in FIG. 2.

During the above-described standby period, the second transfer device 16 is not required to perform second transfer operation to transfer an image to continuous paper P. Hence, at a time point when image quality adjusting processing shown in FIG. 7 is started, the second transfer roller 16A is located at the separate position R1 shown in FIG. 2.

In step S100, the CPU 81 drives the support roller 15A to start transporting the intermediate transfer belt 17. The speed of the intermediate transfer belt 17 is started to increase, as shown in FIG. 8D.

In step S102, the CPU 81 causes the image forming device 14 to form density adjusting images D, such as those shown in FIG. 5, at the central portion of the intermediate transfer belt 17 in the widthwise direction.

In step S104, the CPU 81 causes the density-adjusting-image detector sensor SN1 to detect the density adjusting images D of the individual colors formed on the intermediate transfer belt 17.

In step S106, the CPU 81 executes density adjusting processing based on the densities of the density adjusting images D of the individual colors detected by the density-adjusting-image detector sensor SN1.

More specifically, the CPU 81 calculates the density difference between a predetermined density of each density adjusting image D and the density of the corresponding density adjusting image D detected in step S104. To eliminate the density difference, the CPU 81 adjusts various set values, such as for a developing voltage to be applied to a developing roller by a developing device, which is not shown, the density of toner to be supplied by the developing device, and a bias potential (current) of a first transfer voltage to be applied by the first transfer device 13, in accordance with the density difference.

Various known methods may be used for density adjusting processing. Processing disclosed in Japanese Unexamined Patent Application Publication No. 2005-173253, for example, may be used.

In addition to density adjusting processing, potential adjusting processing for the photoconductor 12 may be executed. In potential adjusting processing, a potential or a current of a charging device is set in accordance with the potential detected by a potential sensor (not shown) provided on the photoconductor 12.

In step S108, the CPU 81 causes the transport device 18 to start transporting continuous paper P. The speed of the continuous paper P is started to increase, as shown in FIG. 8C.

In step S110, the CPU 81 causes the transport device 18 to move the second transfer roller 16A from the separate position R1 to the contact position S1 so that the second transfer roller 16A can contact the intermediate transfer belt 17, as shown in FIG. 8A. The CPU 81 also causes the transport device 18 to move the pressure roller 26A from the separate position R2 to the contact position S2 so that the pressure roller 26A can contact the heat roller 26B, as shown in FIG. 8B.

A first timing at which the second transfer roller 16A moves from the separate position R1 to the contact position S1 and a second timing at which the pressure roller 26A moves from the separate position R2 to the contact position S2 may be the same or may be different. If the first timing and the second timing are different, the first timing may be earlier than the second timing or vice versa.

When the second transfer roller 16A is moved to the contact position S1 while the intermediate transfer belt 17 is being transported, the intermediate transfer belt 17 is sandwiched between the second transfer roller 16A and the backup roller 16B. However, the speed of the continuous paper P varies, as shown in FIG. 8C, and the position of the continuous paper P in the widthwise direction also varies, as shown in FIG. 8E. That is, the transport state of the continuous paper P is changing. It takes some time before the state of the continuous paper P can be stabilized.

The transport state of the continuous paper P is changing refers to that at least one of the transport speed of at least one of the continuous paper P and the intermediate transfer belt 17 and the widthwise position of at least one of the continuous paper P and the intermediate transfer belt 17 varies.

When the pressure roller 26A is moved to the contact position S2 while the continuous paper P is being transported, the continuous paper P is sandwiched between the pressure roller 26A and the heat roller 26B. However, the transport state of the continuous paper P is changing and needs some time before being stabilized. The transport state of the continuous paper P is stabilized refers to that variations in the speed and in the widthwise position of the continuous paper P are reduced to such an extent that misregistration of images formed on continuous paper P can be contained within an allowance.

If position adjusting processing is executed while the transport state of the continuous paper P is still changing, the position adjusting precision is decreased, which may cause misregistration of images of individual colors.

Then, in step S112, the CPU 81 judges whether the transport state of the continuous paper P is stabilized. This judgement may be made according to whether at least one of the transport speed of at least one of the continuous paper P and the intermediate transfer belt 17 and the widthwise position of at least one of the continuous paper P and the intermediate transfer belt 17 is stabilized.

More specifically, if at least one of the following first and second conditions is satisfied, the CPU 81 judges that the transport state of the continuous paper P is stabilized. The first condition is a condition that a variation V in the speed of at least one of the continuous paper P and the intermediate transfer belt 17 per reference time T is equal to or smaller than a predetermined first threshold, as shown in FIGS. 8C and 8D. The second condition is a condition that a variation V in the widthwise position of at least one of the continuous paper P and the intermediate transfer belt 17 per reference time T is equal to or smaller than a predetermined second threshold, as shown in FIGS. 8E and 8F.

The reference time T is set to be a time suitable for detecting a change in the transport state of the continuous paper P. The reference time T may be found by experiment using an actual product of the image forming apparatus 10 or by computer simulations based on the design specifications of the image forming apparatus 10, and may be stored in a predetermined region of the non-volatile memory 84.

For example, if the speed of the continuous paper P is used to judge whether the transport state of the continuous paper P is stabilized, this judgement may be made in the following manner. It is assumed that the length of the continuous paper P in the transport direction is 500 mm, 0.1% of magnification accuracy is required, and the speed of the continuous paper P is 500 mm/s. In this case, the reference time is set to be one second, for example. If the average value of variations in the speed of the continuous paper P for the reference time is ±0.1%, the CPU 81 judges that the transport state of the continuous paper P is stabilized. The reference time is not restricted to one second, and may be set to be a suitable time according to the required magnification accuracy and the speed of the continuous paper P, for example.

The first and second thresholds are set to be values suitable for judging whether the transport state of the continuous paper P is stabilized. The first and second thresholds may be found by experiment using an actual product of the image forming apparatus 10 or by computer simulations based on the design specifications of the image forming apparatus 10, and may be stored in a predetermined region of the non-volatile memory 84.

The speed of the continuous paper P and that of the intermediate transfer belt 17 and the widthwise position of the continuous paper P and that of the intermediate transfer belt 17 may all be used to judge whether the transport state of the continuous paper P is stabilized. Alternatively, among these factors, the one that needs the longest time to stabilize may only be used. For example, the intermediate transfer belt 17 is influenced by the continuous paper P and may not be stabilized until the continuous paper P is stabilized. Thus, one of the speed and the widthwise position of the intermediate transfer belt 17 that needs a longer time to stabilize than the other may only be used to judge whether the transport state of the continuous paper P is stabilized.

If it is judged in step S112 that the transport state of the continuous paper P is stabilized, the process proceeds to step S114. If it is judged in step S112 that the transport state of the continuous paper P is not yet stabilized, judging processing in step S112 is repeatedly executed per reference time until the transport state of the continuous paper P is stabilized.

In step S114, the CPU 81 causes the image forming device 14 to form position adjusting images M, such as those shown in FIG. 5, at both end portions of the intermediate transfer belt 17 in the widthwise direction.

In step S116, the CPU 81 causes the position-adjusting-image detector sensor SN2 to detect the position adjusting images M of individual colors formed on the intermediate transfer belt 17.

In step S118, the CPU 81 executes position adjusting processing based on the positions of the position adjusting images M detected by the position-adjusting-image detector sensor SN2.

Position adjusting processing is processing for adjusting misregistration of images of individual colors. Various known methods may be used for position adjusting processing. Processing disclosed in Japanese Unexamined Patent Application Publication No. 2005-173253, for example, may be used.

In addition to position adjusting processing for adjusting the positions of images of individual colors, processing for adjusting the position of the overall image may be executed. By using the widthwise position of the continuous paper P detected by the transport position detector 25 and that of the intermediate transfer belt 17 detected by the transport position detector 31, for example, the position of an image to be formed on the continuous paper P may be calculated. Then, the transport position of the continuous paper P in the widthwise direction may be corrected, or the position of an image to be formed on the continuous paper P in the widthwise direction by the image forming device 14 may be corrected.

The transport position of the continuous paper P may be corrected by the deviation control device 22, for example. The position of an image to be formed on the continuous paper P may be corrected by adjusting the start position of exposure operation performed by the exposure device (not shown) or by adjusting the positions of individual pixels indicated by image data.

The position of an image formed on the continuous paper P may be detected by an in-line sensor, which is not shown, and the transport position of the continuous paper P in the widthwise direction may be corrected as described above.

The magnification factor of an image formed on the continuous paper P may be detected by a sensor and be corrected.

As described above, in this exemplary embodiment, the CPU 81 performs control so that the pressure roller 26A will contact the heat roller 26B and also the second transfer roller 16A will contact the intermediate transfer belt 17. The CPU 81 then performs control so that, after the transport state of the continuous paper P is stabilized, position adjusting images M will be formed by the image forming device 14 and be detected by the position-adjusting-image detector sensor SN2.

The CPU 81 also performs control so that, before the transport state of the continuous paper P is stabilized, density adjusting images D will be formed by the image forming device 14 and detecting of the density adjusting images D will be started by the density-adjusting-image detector sensor SN1.

If density adjusting processing in step S106 takes a relatively short time, as indicated by a period A shown in FIG. 8G, the transport device 18 may start transporting the continuous paper P in step S108 after density adjusting processing is finished. However, density adjusting processing may take a relatively long time, as indicated by periods A through C shown in FIG. 8G. In this case, if the transport device 18 starts transporting the continuous paper P after density adjusting processing is finished, it takes a long time to execute the entire image quality adjusting processing.

Hence, as shown in FIG. 8C and the lower section of FIG. 8G, the transport device 18 may start transporting the continuous paper P before density adjusting processing is finished. Before density adjusting processing is finished, the second transfer roller 16A may also be moved to the contact position S1, as shown in FIG. 8A, and the pressure roller 26A may also be moved to the contact position S2, as shown in FIG. 8B. It may also be judged whether the transport state of the continuous paper P is stabilized before density adjusting processing is finished.

The exemplary embodiment has been discussed above. However, the present invention is not restricted to the scope of the above-described exemplary embodiment. Various modifications and improvements may be made without departing from the spirit and scope of the invention. Exemplary embodiments implemented by making various modifications and improvements are also encompassed within the technical scope of the invention.

For example, in the exemplary embodiment, the intermediate transfer belt 17 is used. However, the invention is also applicable to the configuration in which an intermediate transfer drum is used. The invention is also applicable to the configuration in which toner images formed on the photoconductor 12, which serves as an image carrier, are directly formed on continuous paper P without using the intermediate transfer belt 17.

In the exemplary embodiment, the image quality adjusting program is installed in the ROM 82. However, the image quality adjusting program may be provided as a result of being recorded in a computer-readable storage medium. For example, a correcting program according to an exemplary embodiment of the invention may be provided as a result of being recorded in an optical disc, such as a compact disc (CD)-ROM or a digital versatile disc (DVD)-ROM, or in a portable storage medium, such as a universal serial bus (USB) memory or a memory card. The image quality adjusting program according to an exemplary embodiment of the invention may be provided as a result of being recorded in a semiconductor memory, such as a flash memory. If the image forming apparatus 10 is connected to a communication network by a communication device, which is not shown, the image quality adjusting program may be obtained via the communication network.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a transfer unit that is disposed in the image forming apparatus so as to be contactable to and separable from an image carrier and that transfers an image formed on the image carrier to a continuous recording medium;

a fixing unit that fixes the image transferred to the continuous recording medium by sandwiching the continuous recording medium between first and second fixing members, the first and second fixing members being disposed in the image forming apparatus so as to be contactable to and separable from each other;

a position adjusting image detector that detects a position adjusting image formed on the image carrier; and a controller that performs control so that the first and second fixing members contact each other and the image carrier and the transfer unit contact each other and thereafter so that the position adjusting image is detected by the position adjusting image detector after a transport state of the continuous recording medium is stabilized.

2. The image forming apparatus according to claim 1, wherein the controller judges that the transport state of the continuous recording medium is stabilized when at least one of a speed of the image carrier and a position of the image carrier in a widthwise direction is stabilized.

3. The image forming apparatus according to claim 2, wherein the controller judges that the transport state of the continuous recording medium is stabilized when at least one of first and second conditions is satisfied, the first condition being a condition that a variation in the speed of the image carrier for a predetermined reference period is equal to or smaller than a predetermined first threshold, the second condition being a condition that a variation in the position of the image carrier in the widthwise direction is equal to or smaller than a predetermined second threshold.

4. The image forming apparatus according to claim 1, further comprising:

a density adjusting image forming unit that forms a density adjusting image on the image carrier, wherein the controller performs control so that the density adjusting image is formed by the density adjusting image forming unit before the transport state of the continuous recording medium is stabilized.

5. The image forming apparatus according to claim 4, further comprising:

a density adjusting image detector that detects the density adjusting image formed on the image carrier, wherein the controller performs control so that detecting of the density adjusting image is started by the density adjusting image detector before the transport state of the continuous recording medium is stabilized.

6. The image forming apparatus according to claim 5, wherein the controller performs control so that transporting of the continuous recording medium starts before density adjusting processing is finished, the density adjusting processing being processing for adjusting density of the image by using the density adjusting image detected by the density adjusting image detector.

7. The image forming apparatus according to claim 6, wherein the controller performs control so that the first and second fixing members contact each other and the image carrier and the transfer unit contact each other before the density adjusting processing is finished.

8. The image forming apparatus according to claim 7, wherein the controller performs control so that judging concerning whether the transport state of the continuous recording medium is stabilized starts before the density adjusting processing is finished.

9. An image forming apparatus comprising:

a transfer unit that is disposed in the image forming apparatus so as to be contactable to and separable from an image carrier and that transfers an image formed on the image carrier to a continuous recording medium;

a fixing unit that fixes the image transferred to the continuous recording medium by sandwiching the continuous recording medium between first and second fixing members, the first and second fixing members being disposed in the image forming apparatus so as to be contactable to and separable from each other;

a position adjusting image forming unit that forms a position adjusting image on the image carrier; and a controller that performs control so that the first and second fixing members contact each other and the image carrier and the transfer unit contact each other and thereafter so that the position adjusting image is formed by the position adjusting image forming unit after a transport state of the continuous recording medium is stabilized.

10. The image forming apparatus according to claim 9, wherein the controller judges that the transport state of the continuous recording medium is stabilized when at least one of a speed of the image carrier and a position of the image carrier in a widthwise direction is stabilized.

11. The image forming apparatus according to claim 10, wherein the controller judges that the transport state of the continuous recording medium is stabilized when at least one of first and second conditions is satisfied, the first condition being a condition that a variation in the speed of the image carrier for a predetermined reference period is equal to or smaller than a predetermined first threshold, the second condition being a condition that a variation in the position of the image carrier in the widthwise direction is equal to or smaller than a predetermined second threshold.

12. The image forming apparatus according to claim 9, further comprising:

a density adjusting image forming unit that forms a density adjusting image on the image carrier, wherein the controller performs control so that the density adjusting image is formed by the density adjusting image forming unit before the transport state of the continuous recording medium is stabilized.

13. The image forming apparatus according to claim 12, further comprising:

a density adjusting image detector that detects the density adjusting image formed on the image carrier, wherein the controller performs control so that detecting of the density adjusting image is started by the density adjusting image detector before the transport state of the continuous recording medium is stabilized.

14. The image forming apparatus according to claim 13, wherein the controller performs control so that transporting of the continuous recording medium starts before density adjusting processing is finished, the density adjusting processing being processing for adjusting density of the image by using the density adjusting image detected by the density adjusting image detector.

15. The image forming apparatus according to claim 14, wherein the controller performs control so that the first and second fixing members contact each other and the image carrier and the transfer unit contact each other before the density adjusting processing is finished.

16. The image forming apparatus according to claim 15, wherein the controller performs control so that judging concerning whether the transport state of the continuous recording medium is stabilized starts before the density adjusting processing is finished.

17. An image forming apparatus comprising:

a transfer unit that is disposed in the image forming apparatus so as to be contactable to and separable from the image carrier and that transfers an image formed on the image carrier to a continuous recording medium;

a fixing unit that fixes the image transferred to the continuous recording medium by sandwiching the continuous recording medium between first and second fixing members, the first and second fixing members being disposed in the image forming apparatus so as to be contactable to and separable from each other; and a controller that performs control so that the first and second fixing members contact each other and the image carrier and the transfer unit contact each other and thereafter so that misregistration of the image is adjusted after at least one of a speed of at least one of the continuous recording medium and the image carrier and a position of the continuous recording medium in a widthwise direction is stabilized.

* * * * *